US005535946A

United States Patent [19]

Clark et al.

[11] Patent Number: 5,535,946

[45] Date of Patent: Jul. 16, 1996

[54] METHOD FOR SHREDDING MATERIAL

[75] Inventors: Ross P. Clark, San Jose; Ronald D. Stewart, Hollister, both of Calif.

[73] Assignee: United Technologies Corporation, Hartford, Conn.

[21] Appl. No.: 235,014

[22] Filed: Apr. 28, 1994

[51] Int. Cl.[6] ..... B02C 4/08; B02C 19/12

[52] U.S. Cl. ..... 241/18; 241/23; 241/65; 241/DIG. 37

[58] Field of Search ..... 241/18, 23, 236, 241/65, DIG. 37

[56] References Cited

U.S. PATENT DOCUMENTS

| | | | |
|---|---|---|---|
| 4,240,587 | 12/1980 | Letsch | 241/23 |
| 4,493,806 | 1/1985 | Hatzikelis et al. | 264/28 |
| 4,813,614 | 3/1989 | Moore et al. | 241/23 |
| 4,981,535 | 1/1991 | Hadermann et al. | 241/DIG. 37 X |
| 5,011,087 | 4/1991 | Richardson et al. | 241/5 |
| 5,025,632 | 6/1991 | Spritzer | 241/DIG. 37 X |
| 5,301,881 | 4/1994 | Hayashi et al. | 241/65 |
| 5,333,802 | 8/1994 | Seelig et al. | 241/65 |

FOREIGN PATENT DOCUMENTS

| | | | |
|---|---|---|---|
| 2044126 | 10/1980 | United Kingdom | 241/DIG. 37 X |

OTHER PUBLICATIONS

Taskmaster Shredder Brochure 1992 and Quotation from Franklin Miller via LMH Inc. Representatives & Distributors.

*Primary Examiner*—John M. Husar
*Attorney, Agent, or Firm*—Alan C. Cohen

[57] ABSTRACT

The present invention discloses a method for safely and easily shredding a variety of material particularly material having a low melt temperature and/or containing material sensitive to high static electric charges, such as 1.1 and 1.3 class material. The method comprises applying a cloud of gas vapor onto the shredding means to cool the shredding means to a temperature below that of the melt temperature of the material being shredded and to also reduce the static electric charge on the resulting particles of material which may develop during the shredding process. Further described is an apparatus for carrying out the method.

8 Claims, 1 Drawing Sheet

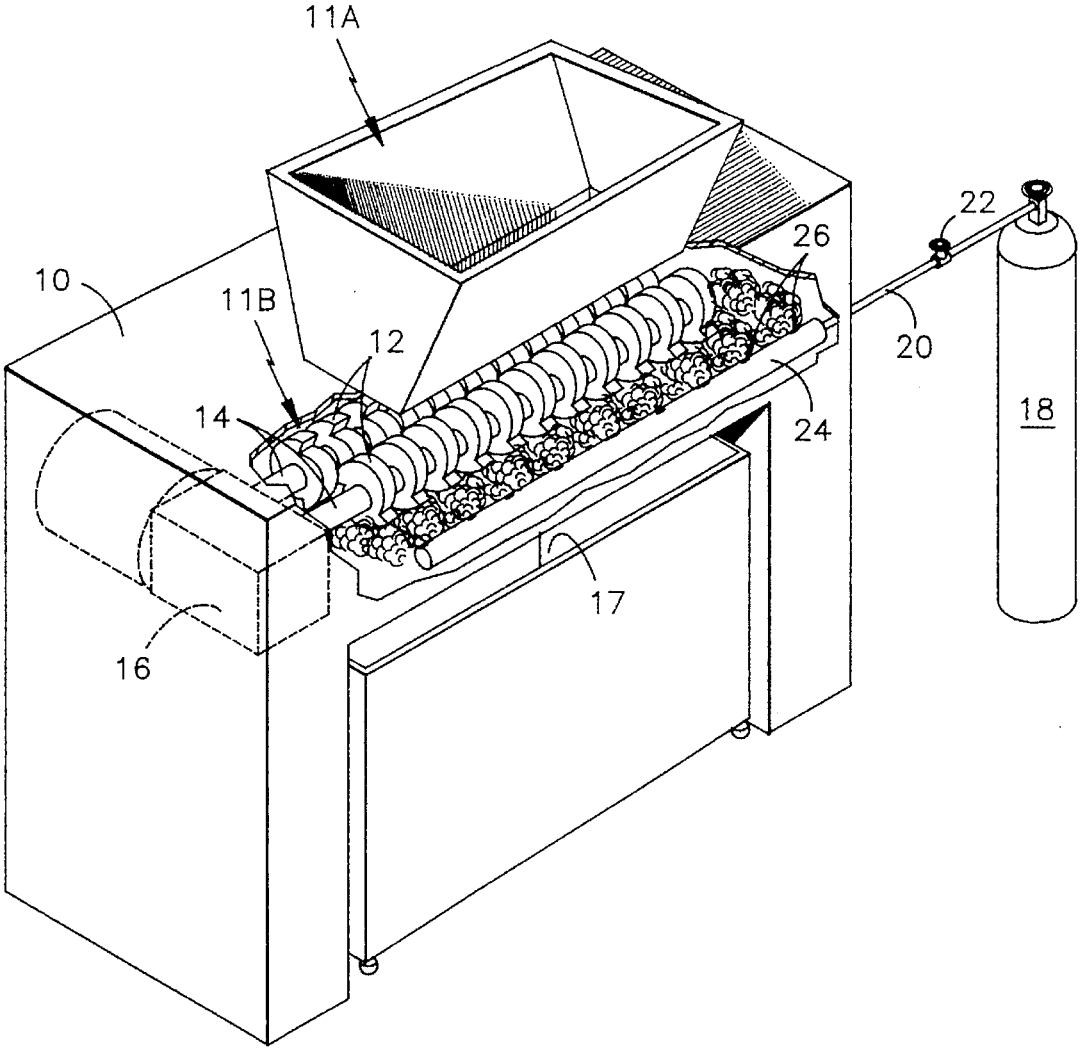
11A
10
11B
12
14
16
17
18
20
22
24
26

METHOD FOR SHREDDING MATERIAL

TECHNICAL FIELD

The technical field to which this invention pertains is processes for shredding various materials, particularly materials which have low melting temperatures and/or are affected by static electricity.

BACKGROUND OF THE INVENTION

Many processes may be used to reduce the size of various materials, these include chopping, cutting, shredding, etc. Depending on the amount of material to be reduced, the nature of the material and the final size desired of the reduced material one process will be chosen over another.

In those instances where relatively small particle sizes are desired and high volumes of material are to be processed shredding is often the method of choice. Most people are familiar with paper shredders or similar devices which utilize reciprocating or counter-rotating blades which interlock one another such that when a material is introduced between the moving blades the material is shredded.

During the course of using these shredding devices it has been found that, due to friction, the temperature of the blades rises significantly. In addition, again due to the mechanical action of the devices, static electricity may be formed on the particles of shredded material themselves, sometimes to rather high electrical potentials.

It is desirable to use these traditional shredding processes to shred certain plastic materials or materials which are sensitive to static electrical charges. However, in view of the above mentioned side effects of such shredding processes such methods are currently impractical.

One approach to solving these problems would be to introduce water or some other coolant into the process to reduce the temperature or the formation of static electricity. However, there are environmental concerns with disposal of such coolants and in those instances where the shredded material is to be recycled the presence of such coolant is undesirable.

Therefore what is needed is a method for shredding such materials while reducing or mitigating the effects of the shredding process byproducts.

DISCLOSURE OF THE INVENTION

The present invention discloses a method for shredding materials which would be detrimentally affected by temperature or static electricity generated during the shredding process. The process comprising introducing a cloud of a low temperature gas over the shredding means sufficient to cool the shredding means to a temperature below the melt temperature of the material being shredded and reducing the static electrical charge generated on the shredded material.

Further, the invention also discloses an apparatus for practicing the method of shredding described above. In particular, a shredder equipped with a means for introducing a cloud of a low temperature gas over the shredding means to reduce the static electricity charge created on the shredded material due to the shredding process and to maintain the temperature of the shredding means below the melt temperature of the material being shredded.

BRIEF DESCRIPTION OF THE FIGURE

The FIGURE depicts a shredding apparatus useful in carrying out the present invention.

BEST MODE FOR CARRYING OUT THE INVENTION

Most conventional shredders (such as the TASKMASTER® by Franklin Miller of Livingston, N.J.) useful in shredding materials utilizing moveably engagable blades to shred or tear apart material to smaller sizes may be used to practice this invention. Typically, these shredders are configured as shown in the FIGURE in which the apparatus comprises a housing 10, containing a device 11A for directing the material to be shredded into the shredding means, shredding means 11B which comprise two interlocking sets of blades 12 (in this instance the blades 12 are positioned on two opposing rollers 14 which are parallel to one another and which are caused to counter-rotate relative to each other by a gear box 16), which when operating sufficiently engage one another to cause any material placed between the blades to be chopped, sliced, torn, or otherwise reduced in size. The material having passed through the blades 12 and between the rollers is then gravity fed to a catch basin 17. Typically these shredders are capable of shredding sheets of material into particles of about 2.5 × about 2.5 inches in size. However, the actual size may vary depending on the material shredded, the proximity of the shredding blades to one another and the power of the shredding motor.

The shredder of the present invention includes a means for simultaneously reducing the temperature of the rollers and the static electricity resulting from the shredding process. This means includes a means for introducing a cloud of an inert, low temperature gas, such as nitrogen over the rollers to cool the rollers to a desired temperature and to reduce static electricity buildup. (By using the term cloud to describe the cooling gas, this is meant to include a combination of cool gas and liquefied gas particles or a foglike composition.) One means for accomplishing this is to have a source of liquefied gas, preferably a large capacity dewar 18 or other thermally insulated tank, which is in fluid communication with a manifold or other means capable of distributing a vapor fog of the liquefied gas over the shredder means, in particular the blades or cutting means located on the rollers.

As is shown in the FIGURE the fluid pathway 20 from the storage container 18 of the liquefied gas is connected to a valve 22 for controlling the flow of the cloud to the distribution means. In the preferred embodiment the fluid pathway is connected to a manifold 24 positioned underneath and parallel with the cutting means. The manifold having numerous openings 26 in its surface to permit the cloud to exit the manifold through the openings in the surface. These openings should extend along the entire length of the rollers so as to develop a cloud sufficient to cool the entire length of the blades to a temperature below the melt temperature of the material being shredded and to reduce the static electricity charge to a desired level. The design of the manifold or other means to create the cloud around the cutting means or blades to sufficiently cool or dissipate the electric charge is subject to many design criteria and may be manifested in many different forms. These design choices would be known to those skilled in this engineering art.

The type of gas used and the flow or quantity of cloud metered toward the cutting means will depend on the nature of the liquefied vapor and the materials being shredded. The actual materials and the operating conditions will vary, however, they are easily determined through simple experimentation.

The purpose of the cloud is to lower the temperature of the cutting device through a thermal transfer of heat from the cutting means to the gas/vapor and to cause the dissipation of the static electrical charge which develops on certain materials as they are shredded.

Although it is not exactly clear why the cloud is able to dissipate the static electric charge which develops on the surface of the shredded particles, and the applicant does not wish to be bound by any one theory, it is believed that when the particles are cooled by the cloud, water vapor in the atmosphere is caused to condense in the vicinity of the particles thereby causing electrically conductive pathways permitting the electric charge to dissipate.

The process will have its most useful practice in shredding low melt temperature plastics such as polyethylene, and materials which contain electrically sensitive materials such as rocket propellant or other materials which could be pyrotechnic in the presence of an elevated electrical charge.

Typically, it is desirous to use a coolant fog or mist having a temperature ranging from about +40° F. to about 0° F. Many liquid gases could be used, however, due to environmental concerns, liquid nitrogen or argon are preferred with liquid nitrogen most preferred. It is preferred that the coolant be used in such quantities and be capable of lowering the temperature of the cutters to between about 280° F. to below about 90° F. The material should also be capable of reducing the static electrical fields which develops on the surface of the shredded material to below 5000 volts. This will prevent most pyrotechnic materials from igniting at these levels of static electricity. Again the same liquid gases, nitrogen and argon may be used with nitrogen being preferred.

The process is practiced by applying power to the shredder means thereby actuating the cutting means. Opening the valve or otherwise causing the liquefied gas vapors to flow through the manifold and thereby creating the cloud about the cutting means at a flow rate capable of maintaining the temperature of the cutting means below the melt temperature of the material being cut and also maintaining the static electric charge below a predetermined amount to prevent ignition of any pyrotechnic material which may be present.

As a result of operating the process at the specified parameters the material being shredded does not melt on contact with the cutting means and thereby clog the cutters and cause undesirable down time to clean the cutters. Additionally, this process prevents clumping of the cut material as it exits the cutting means. In addition by lowering the static electricity charge which develops on the shredded or cut material to predetermined levels certain sensitive or pyrotechnic materials may be safely shredded. All of this being achieved without the generation of a wet product which is less desirable from an environmental standpoint as well as more costly to recycle.

We claim:

1. A method for shredding various pyrotechnic containing materials comprising;

introducing the material to be shredded into a shredding device having a shredding means for shredding the material, and directing a cloud of liquefied gas vapor onto the shredding means of the shredding device to cool the shredding means to a temperature below the melt temperature of the material to be shredded, and to dissipate the static electrical charge developed on the surface of the shredded material to below 5,000 volts.

2. The method of claim 1 wherein the cloud is formed from liquefied nitrogen or argon.

3. The method of claim 1 wherein the cloud reduces the temperature of the shredder means to below 90° F.

4. The method of claim 1 wherein the material being shredded contains a pyrotechnic material.

5. The method of claim 1 wherein the gas vapor has a temperature of from about 40° F. to about 0° F.

6. The method of claim 1 wherein the shredding means comprises two interlocking sets of blades which parallel to one another and counter rotate relative to each other.

7. An apparatus for shredding material containing pyrotechnic matter comprising;

a shredding device having a shredding means; and a means for introducing material to be shredded into the shredding means; and a means for applying a cloud of a gas vapor onto the shredding means thereby lowering the temperature of the shredding means below the melt temperature of the material to be shredded and to reduce the static electricity developed on the surface of the shredded material to below 5,000 volts.

8. The apparatus of claim 7 wherein the cloud lowers the temperature of the shredding means to a temperature below 90° F.

* * * * *